US011865607B2

(12) United States Patent
Salvador et al.

(10) Patent No.: US 11,865,607 B2
(45) Date of Patent: Jan. 9, 2024

(54) METHOD TO OBTAIN A CONTINUOUS CASTING APPARATUS AND CONTINUOUS CASTING APPARATUS THUS OBTAINED

(71) Applicant: Danieli & C. Officine Meccaniche S.p.A., Buttrio (IT)

(72) Inventors: Nikolas Salvador, Sarmede (IT); Luca Entesano, Udine (IT); Andrea De Luca, Remanzacco (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 225 days.

(21) Appl. No.: 17/413,329

(22) PCT Filed: Nov. 28, 2019

(86) PCT No.: PCT/IT2019/050249
§ 371 (c)(1),
(2) Date: Jun. 11, 2021

(87) PCT Pub. No.: WO2020/121348
PCT Pub. Date: Jun. 18, 2020

(65) Prior Publication Data

US 2022/0288672 A1 Sep. 15, 2022

(30) Foreign Application Priority Data

Dec. 12, 2018 (IT) ..... 102018000011025

(51) Int. Cl.
*B22D 11/00* (2006.01)

(52) U.S. Cl.
CPC ..... *B22D 11/009* (2013.01)

(58) Field of Classification Search
CPC ..... B22D 11/009
See application file for complete search history.

(56) References Cited

U.S. PATENT DOCUMENTS

2008/0264598 A1 10/2008 Morales et al.

FOREIGN PATENT DOCUMENTS

DE 4417221 A1 11/1994
JP H06134550 A 5/1994

OTHER PUBLICATIONS

Int'l Search Report and Written Opinion dated Apr. 7, 2020 in Int'l Application No. PCT/IT2019/050249.

*Primary Examiner* — Kevin P Kerns
*Assistant Examiner* — Steven S Ha
(74) *Attorney, Agent, or Firm* — Panitch Schwarze Belisario & Nadel LLP

(57) ABSTRACT

Method to obtain a continuous casting apparatus to cast, through the casting cavity of a crystallizer of a mold, a cast product with a polygonal cross section.

13 Claims, 8 Drawing Sheets

SEC. V-V

SEC. V-V

SEC. VIII-VIII

SEC. V-V

METHOD TO OBTAIN A CONTINUOUS CASTING APPARATUS AND CONTINUOUS CASTING APPARATUS THUS OBTAINED

CROSS-REFERENCE TO RELATED APPLICATIONS

This application is a Section 371 of International Application No. PCT/IT2019/050249, filed Nov. 28, 2019, which was published in the English language on Jun. 18, 2020, under International Publication No. WO 2020/121348 A1, which claims priority under 35 U.S.C. § 119(b) to Italian Application No. 102018000011025, filed Dec. 12, 2018, the disclosures of each of which are incorporated herein by reference.

FIELD OF THE INVENTION

The present invention concerns a method to obtain a continuous casting apparatus for the production of billets having a polygonal cross section.

The present invention also concerns a continuous casting apparatus obtained with the production method.

In particular, the method and the apparatus, in accordance with the present invention, allow to cast billets with a greater casting speed than known methods and apparatuses, obtaining an increase in the productivity of the entire apparatus, considerably reducing or eliminating the containment of the billets downstream of the mold.

BACKGROUND OF THE INVENTION

Continuous casting apparatuses are known which comprise a mold configured to cast products with a substantially square cross section, or with a round cross section. A known continuous casting apparatus is described for example in document US-A-2008/264598.

The molten metal is introduced into the mold in order to be progressively solidified with the formation of a solid skin.

At the exit from the mold the cast product has a solidified external shell which has the function of containing the liquid metal still present inside it. The mold also defines a casting line along which the solidifying metal product progressively advances.

Known apparatuses also comprise, directly downstream of the mold, a containing device configured to prevent the bulging of the skin of the cast product, which occurs due to the ferrostatic pressure exerted by the liquid metal. This phenomenon occurs mainly in the case of casting products with a substantially square cross section in which the sides of the cross section, if not properly contained, tend to bulge outward. This deformation can lead to the formation of cracks that, if they extend up to the external surface, cause the skin to break, with the consequent breakout of liquid metal. This phenomenon is prevented through a plurality of units of containing rollers.

Each containing unit is provided with containing rollers which peripherally surround, during use, a portion of the cast product.

Between the containing rollers there are provided devices for cooling, so-called secondary cooling, the metal product, such as delivery nozzles.

The position of the containing rollers with respect to the external surface of the cast product has to be accurately adjusted for the correct containment of the sides of the cross section. In particular, whenever a breakout, or a degradation of the quality of the cast product itself occurs, for example due to the presence of internal or surface cracks, an action is required to adjust the position of the containing rollers.

The adjustment of the position of the rollers is carried out considering at least the shrinkage in size of the material due to the secondary cooling, and the need to not excessively compress the product in order to not deform it and therefore hinder its advance along the casting line.

The operations to adjust the alignment of the containing rollers are complex and are performed manually off line by specialized operators, requiring prolonged time, and high maintenance and operating cost.

Furthermore, maintenance of the containing devices requires a suitable stock of spare parts, with corresponding management costs, and places restrictions on the operation of the casting machine if more breakouts occur in the same week.

It is also known that the production of round cross section billets allows to reduce, or even eliminate, the number of containing units along the casting line with respect to the production of products with a substantially square cross section, thanks to the greater capacity of the round product to support itself and resist the ferrostatic pressure of the liquid metal contained by the solidified skin.

It is also known that the casting of round products allows to obtain a cooling of the cross section of the cast product that is highly homogeneous, and therefore allows to obtain a cast product of high quality.

On the other hand, however, round products do not allow to reach high casting speeds, since the internal taper of the crystallizer, although studied and optimized, does not allow perfect contact with the cast product in all process conditions, and therefore during the shrinkage the solidified skin tends to detach from the walls of the crystallizer, reducing the uniformity of the heat exchange.

Usually, round cross sections are cast with casting speeds comprised between 0.2 and 2.0 m/min.

Billets with a substantially square cross section, on the other hand, given the same containing length as those with a round cross section, allow to reach higher casting speeds, for example up to 4-5 m/min, and therefore higher productivity.

The casting speeds of the substantially square cross sections can be increased, provided that a containing device with an adequate length is used, which in any case will be greater than that required by a round cross section. In fact, at high casting speeds, the skin at exit from the crystallizer is thinner and hotter and has a greater tendency to bulge under the action of the ferrostatic pressure.

Furthermore, products with a substantially square cross section, compared to round products, have a surface temperature that is not uniform. The edges, in fact, can be colder than the center-face, and can therefore generate defects in the subsequent rolling processes downstream.

It is a purpose of the invention to perfect a method to obtain a continuous casting apparatus that allows to reach much higher casting speeds, and therefore productivity, than current known solutions.

It is also a purpose of the invention to perfect a method to obtain a continuous casting apparatus that at the same time allows to reduce the longitudinal extension of the containing device, or even eliminate it completely. This is to the benefit of a reduction in the number of containing rollers and therefore also the actions of adjustment and alignment required for their correct positioning.

Another purpose of the present invention is to perfect a method to obtain a continuous casting apparatus which allows to obtain cast products with a higher quality, both surface and also internal.

Another purpose of the present invention is to provide an apparatus for continuous casting which reduces capital expenditure (CAPEX) and operational expenditure (OPEX), and which allows to considerably reduce maintenance interventions.

It is also a purpose of the invention to perfect a casting apparatus which allows to reach much higher casting speeds, and therefore productivity, than in known solutions.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, a method is provided to obtain a continuous casting apparatus for casting, through the cavity of a crystallizer of a mold, a product with a polygonal cross section.

In accordance with one aspect of the invention, the method provides to determine the minimum containing length of a containing device with rollers located downstream of the mold and configured to contain the deformation of the cast product with a containing device with rollers. The minimum containing length is determined, on each occasion, as a function at least of the width of the side of the polygon, of a maximum admissible deformation camber of the side of the polygonal cast product outside the mold, and of the casting speed.

In some embodiments, the method also provides the case in which the containing length is equal to zero and therefore it is not necessary to contain the cast product downstream of the mold with the containing device.

The present invention allows to provide a teaching with regards to the need or not to provide a containment of the cross section of the cast product in order to avoid the bulging phenomena which lead to the breaking of the skin, above all at high casting speeds. By suitably controlling the deformation camber of the side of the cast product, and according to the sizes of the sides of the polygon and to the casting speed, it is in fact possible to identify whether it is necessary to provide a length for containing the product and, if so, to identify its minimum length required.

By reducing, or eliminating, the presence of the containing device it is possible to mechanically simplify the containing devices themselves and/or facilitate their maintenance and/or adjustment, such as for example the alignment of the rollers, with a considerable reduction in time and costs.

Possible implementations of the present invention can provide that the cross section of the casting cavity is octagonal in shape.

The Applicant has in fact tested that by casting a product with an octagonal cross section it is possible to increase the support capacity of the solid structure of the product even for rather thin thicknesses of the skin, and in this way, it is possible to reach higher casting speeds than known solutions.

For some combinations of casting speed and length of the side of the octagon, the containing device can advantageously be completely eliminated.

Embodiments of the present invention also concern a continuous casting apparatus which comprises a mold provided with a crystallizer defining a casting cavity with a polygonal cross section. Starting from the exit end of the mold and for a predefined containing length, there is a containing device, and wherein the containing length is calculated with the method described above.

In accordance with one aspect of the invention, the casting apparatus can comprise a containing device provided with containing rollers configured to contain the deformation of the cast product outside the mold, this device having a minimum length strictly necessary to prevent an excessive bulging of the faces of the polygonal cross section.

Moreover, the containing device extends starting from the lower end of the mold for a minimum containing length determined, on each occasion, as a function at least of the width of the side of the polygonal cross section, of a maximum admissible deformation camber of said side of the polygon outside the mold, and of the casting speed.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
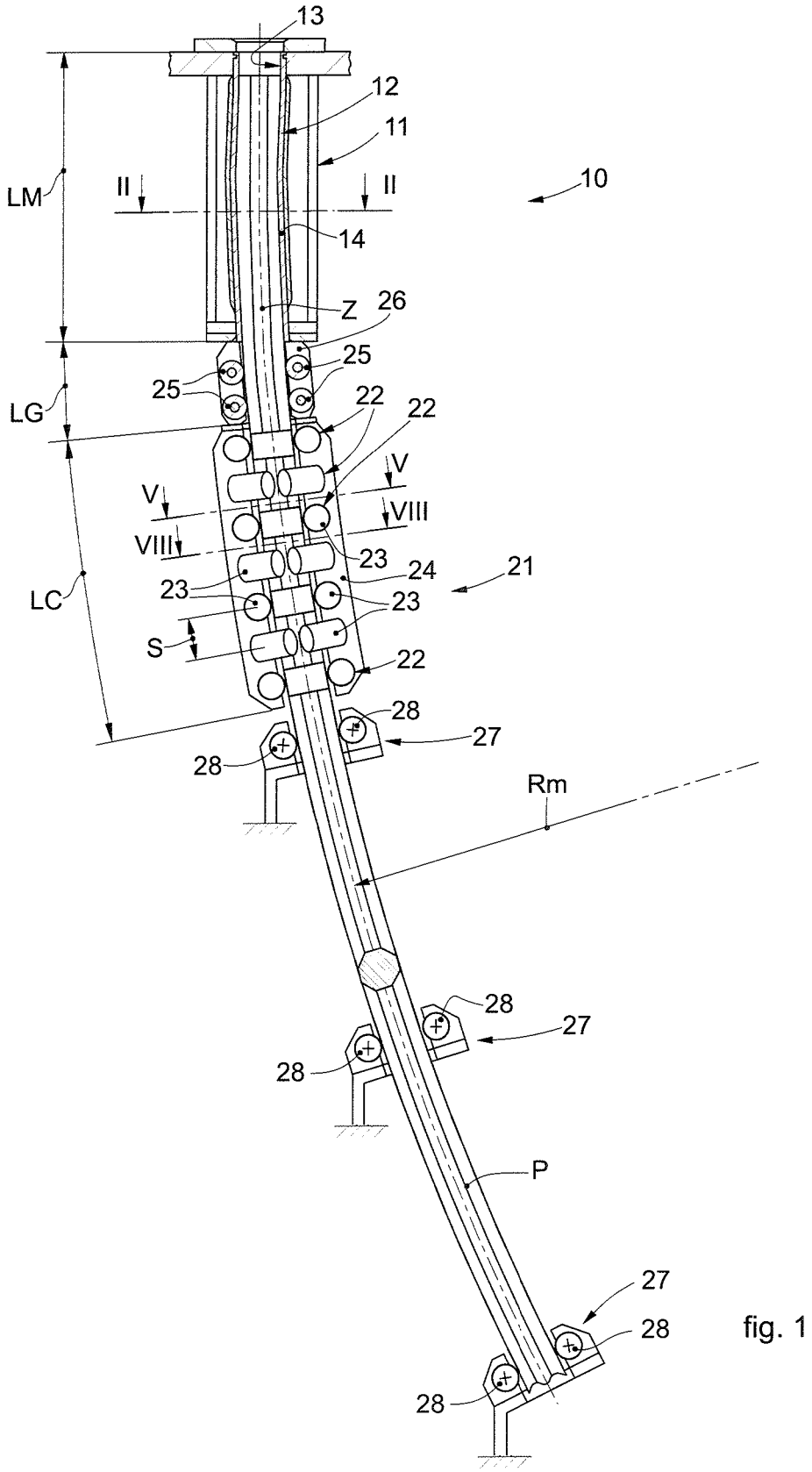
FIG. 1 is a schematic lateral view of a continuous casting apparatus, in accordance with the present invention, obtainable with a production method according to the invention.

Embodiments of the present invention concern a method to obtain a continuous casting apparatus indicated as a whole with reference number 10, and configured to produce a cast product P.

In accordance with possible solutions, the apparatus 10 has a high productivity, for example greater than 50 ton/h.

The apparatus 10, according to the present invention, comprises a mold 11 provided with a crystallizer 12 configured to solidify the liquid metal which is introduced inside it.

The mold 11 also defines a casting line Z along which the metal product P being solidified transits.

The crystallizer 12 has a casting cavity 13 with a polygonal cross section, that is, defined by a predefined number of sides greater than three.

The cross section of the casting cavity 13 substantially defines the shape of the cross section of the cast product P.

Preferably, the number of sides of the cross section can be an even number, that is, a multiple of two.

Even more preferably, the number of sides of the cross section can be four, or a multiple of four.

In the following description and in the drawings, we mainly refer to an octagonal cross section, but similar considerations can also be applied to a polygonal cross section with a number of sides other than eight.

Figure 9:
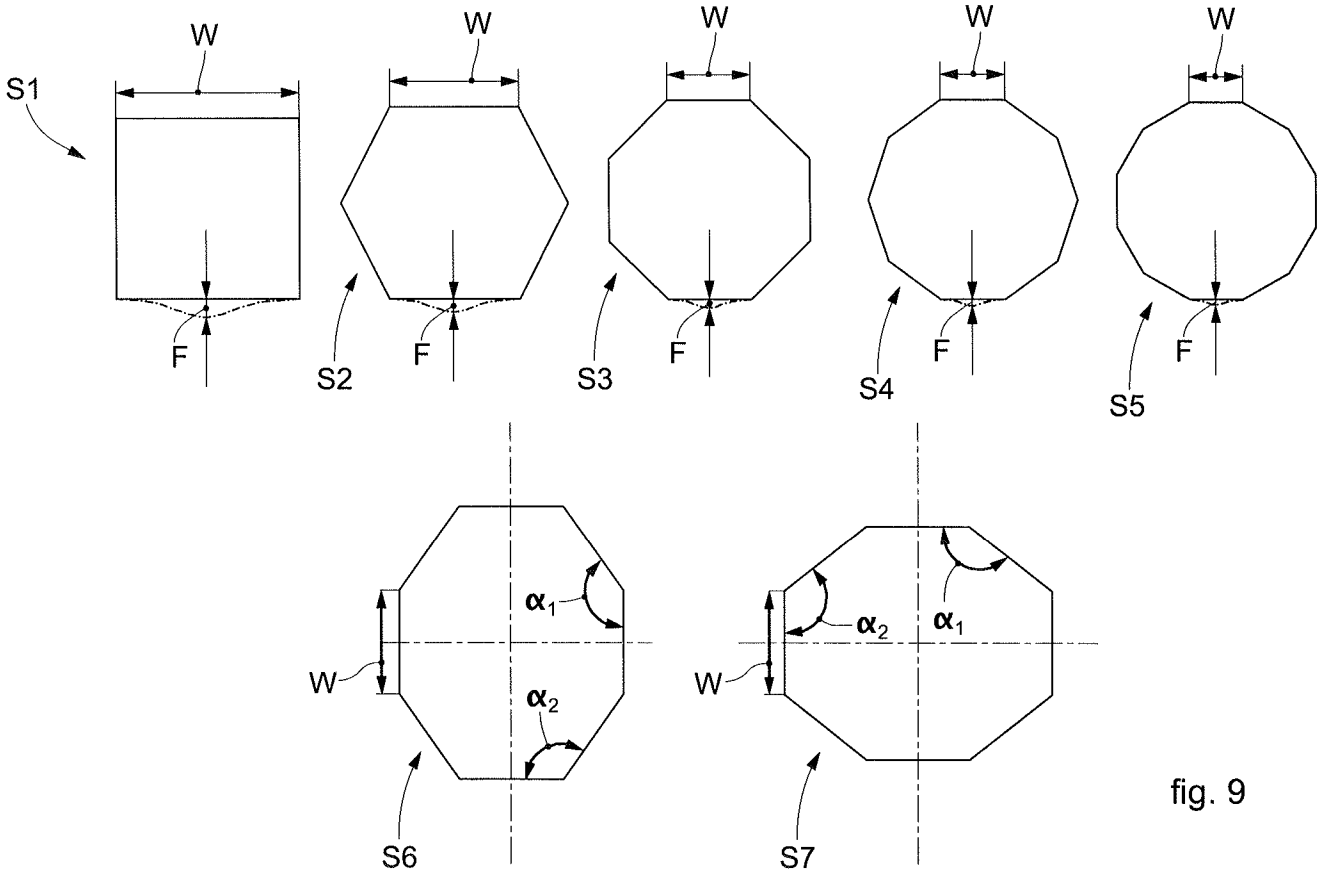
FIG. 9 schematically shows polygon shapes which represent cross sections which can be cast with the method and the apparatus in accordance with the present invention, which have the same cross section sizes.

Examples of cross sections S1, S2, S3, S4, S5, S6 and S7 which can be obtained for the cast product P by means of the present apparatus 10 are shown for example in FIG. 9. In these examples, regular cross sections can be observed, for example square (S1), hexagonal (S2), octagonal (S3), decagonal (S4), dodecagonal (S5), or others, and which can be regular (from S1 to S5) or irregular (S6 and S7).

In accordance with possible embodiments, the cross section S3 of the cast product P can be a regular octagon with the sides, that is, the walls, all equal to each other, with a length W and the angles ($\alpha$) between the sides which are also equal to each other and equal to 135 degrees.

In accordance with other possible embodiments, it is provided that the cross section S6, S7 of the cast product P can be an octagon with the sides, that is, the walls, of different lengths from one another, in which the difference in length between the longer side ($W_L$) and the shorter one ($W_S$) can vary from 5% to 20%, preferably from 5% to 10%.

In these embodiments S6, S7, the octagonal cross section of the crystallizer can therefore have 6 sides, opposite each other, of a shorter length $W_S$ and 2 sides, opposite each other, of a greater length $W_L$, wherein all the angles ($\alpha$) between the adjacent sides are all equal to each other, with a value of 135 degrees, to respect the symmetry of the cross section around the respective axes.

According to further possible variant embodiments, the cross section of the cast product can have sides all of a length (W) equal to each other and disposed so as to form angles of different amplitude in which said opposite angles are equal to one another with a value comprised between about 125 degrees and about 145 degrees, preferably between about 130 degrees and 140 degrees.

The cross section S7 of the cast product P is rotated by 90° with respect to the cross section S6, consequently the cast products P with said cross sections will have different intrados and extrados sides.

The crystallizer 12 comprises a plurality of walls 14 reciprocally associated with each other to define the casting cavity 13.

The walls 14, that is, the sides of the cross section, have widths W substantially equal to each other.

The walls 14 can all have the same thickness to ensure uniform cooling of the cast product P.

The walls 14 can be connected to each other in correspondence with the edges 15.

The edges 15 can be rounded or bevelled.

Figure 2:
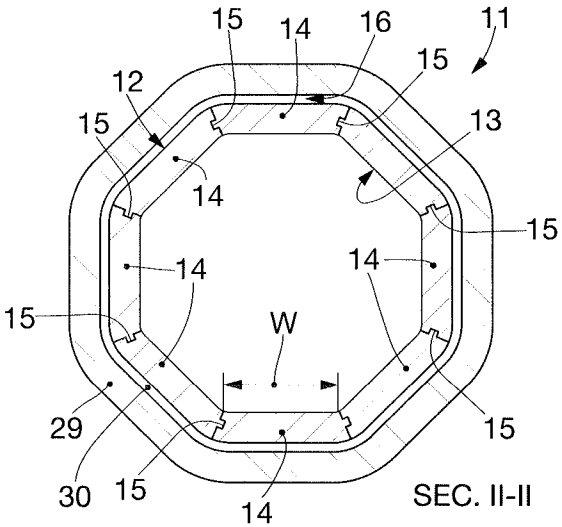
FIG. 2 is a cross section view, along the section line II-II, of FIG. 1.

In accordance with possible embodiments (FIG. 2), the walls 14 can be distinct and separate elements and connected in correspondence with the edges 15 by connection means, for example threaded.

Figure 4:
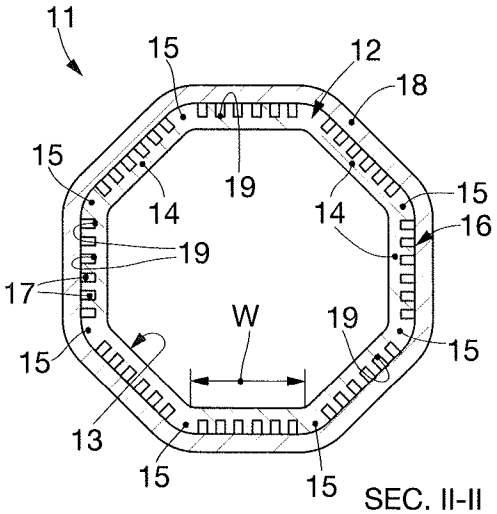
FIG. 4 is another variant of FIG. 2.
Figure 3:
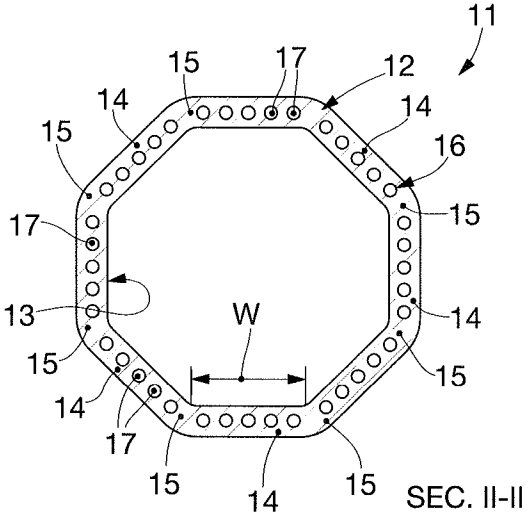
FIG. 3 is a variant of FIG. 2.

According to possible variant embodiments (FIGS. 3 and 4), the walls 14 can be connected together in a single body, that is, to define a monolithic body.

The crystallizer 12 is also provided with cooling devices 16, also referred to in the art as primary cooling devices, configured to cool the molten metal in contact with the walls 14.

According to a possible variant embodiment (FIG. 2), the cooling devices 16 comprise an external jacket 29 in which the crystallizer 12 is inserted. A hollow space 30 is defined between the external jacket 29 and the crystallizer 12 and externally surrounds the entire crystallizer 12 and in which, during use, the cooling fluid is circulated.

According to possible solutions of the invention, the cooling devices 16 (FIGS. 3 and 4) comprise cooling channels 17, associated with the crystallizer 12 and in which a cooling liquid is circulated.

In particular, according to a possible variant embodiment (FIG. 3), the crystallizer 12 can be provided, in its thickness, with a plurality of cooling channels 17 which develop in a direction substantially parallel to the longitudinal development of the mold 11.

According to another variant embodiment (FIG. 4), the crystallizer 12 is provided on its external surface with a plurality of grooves 19 made open toward the outside and parallel to the longitudinal development of the crystallizer 12 itself.

In accordance with a possible solution (FIG. 4), on the surface that is external during use, a coating layer 18 is applied with the purpose of closing, with respect to the outside, the grooves 19 and defining the cooling channels 17. The coating layer 18 can be made with bundles of fibers, for example carbon fibers, wrapped around the axis of the casting line Z and impregnated with a polymeric resin.

According to other solutions, the grooves 19 can be closed to define the cooling channels 17 as above according to one and/or the other of the embodiments described in WO-A-2014/207729 in the name of the Applicant.

According to a possible solution, the cooling devices 16 can comprise feed and discharge members, not shown in the drawings, and configured to circulate the cooling fluid along the cooling channels 17.

The crystallizer 12 has a crystallizer length LM, determined along the casting line Z. The crystallizer length LM can be comprised between 500 mm and 1500 mm, preferably between 780 mm and 1000 mm.

In accordance with one aspect of the present invention, the apparatus 10 comprises, downstream of the mold 11, a containing device 21 configured to contain the deformation toward the outside of the faces of the cast product P at exit from the mold 11.

The containing device 21 can be provided with a plurality of containing units 22 located one after the other and each provided to contain a portion of the cast product P.

The containing units 22 are distanced from each other along the casting line Z by a predefined pitch "S".

The pitch S can be uniform along the casting line Z.

According to possible embodiments, the pitch S can increase progressively along the casting line Z moving downstream, since the solidified skin assumes gradually increasing thicknesses thanks to the secondary cooling and therefore increases its resistance to ferrostatic pressure.

In accordance with possible solutions of the invention, the containing rollers 23 of adjacent containing units 22 are distanced from each other, along the casting line Z, by a pitch S comprised between 1.05 and 5 times the diameter of the containing rollers 23.

Each containing unit 22 is provided with a plurality of containing rollers 23 lying on a same lying plane and which surround, during use, the perimeter of the cast product P.

Figure 5:
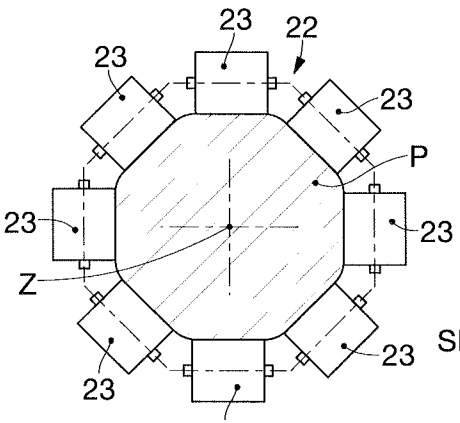
FIG. 5 is a cross section view along the section line V-V, of FIG. 1 in accordance with one possible solution.

In accordance with a first solution (FIG. 5), it can be provided that each containing unit 22 comprises a number of containing rollers 23 equal to the number of sides of the polygon defining the cross section of the cast product P, and wherein a respective containing roller 23 is associated with each side of the polygon.

Figure 6:
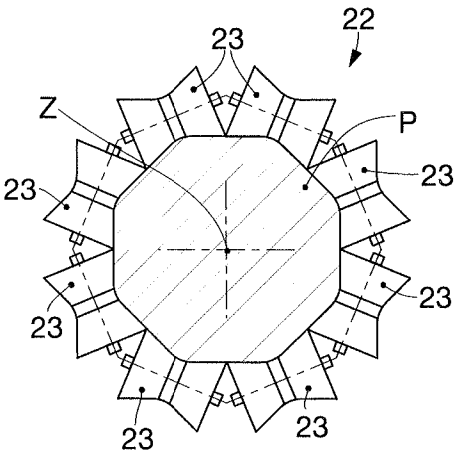
FIG. 6 is a variant of FIG. 5.

According to a variant embodiment (FIG. 6), it can be provided that each containing unit 22 comprises a number of containing rollers 23 equal to the number of sides of the polygon defining the cross section of the cast product P and wherein each containing roller 23 is associated with a respective edge of the polygon. In this case, therefore, each containing roller 23 is suitably shaped to rest on two adjacent sides of the cross section of the cast product P.

According to another variant embodiment (FIGS. 7 and 8), it can be provided that each containing unit 22 comprises a number of containing rollers 23 equal to half the number of the sides of the polygon defining the cross section of the cast product P, and said rollers are disposed in pairs opposite each other and positioned, during use, in contact with respective sides of the polygon.

The containing unit 22 adjacent and subsequent with respect to the one considered has the same number of rollers as the previous unit but is angularly offset with respect thereto so that its pairs of rollers are in contact with the remaining sides of the polygon.

Figure 7:
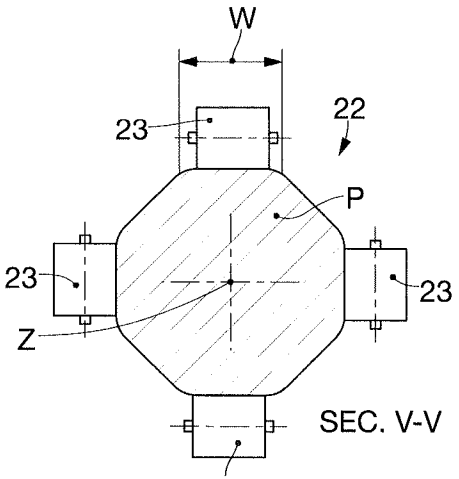
FIG. 7 is another variant of FIG. 5.

With reference, for example, to an octagonal cross section shown in FIG. 7, one of the pairs has its containing rollers 23 located respectively on the intrados side and on the extrados side of the cast product P, or of the casting line Z. The other pair of containing rollers 23 is rotated by 90° with respect to the disposition of the containing rollers 23 of the first pair, and is in contact with the lateral sides of the product.

Figure 8:
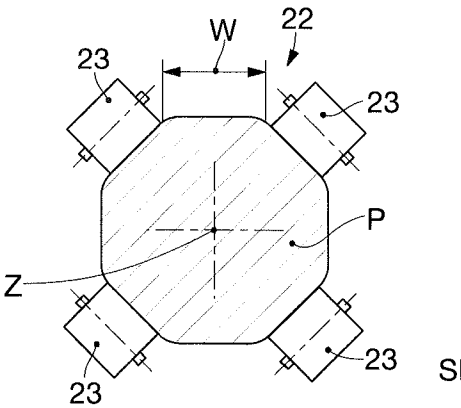
FIG. 8 is a cross section view along the section line VIII-VIII of FIG. 1.

The containing rollers 23 of a first containing unit 22 are located in contact with four of the eight sides of the cast product P (FIG. 7). FIG. 8 shows the containing unit 22 immediately downstream and adjacent to the first containing unit 22 which is also equipped with four rollers and is angularly offset by 45° with respect to the previous one so as to contain the other four faces.

In accordance with a possible solution of the invention, the containing devices 21 comprise at least one support frame 24 configured to support all the containing units 22.

The support frame 24 allows to define the precise and reciprocal positioning of each of the containing units 22 with respect to the others.

The support frame 24 can be installed in a fixed position, that is, it does not oscillate together with the mold 11.

In accordance with possible implementations of the invention, the mold 11 comprises a plurality of guide rollers, also called foot rollers 25, disposed at the exit end of the crystallizer 12 and which form an integral part of the mold 11.

The foot rollers 25 guide the exit of the cast product P and have the function of keeping it centered in the crystallizer 12 so that all the walls of the cast product P are in contact with the respective internal surfaces of the crystallizer 12 and therefore the heat exchange is uniform on all faces.

In possible implementations of the invention, the foot rollers 25 are connected to, and integrally mobile with, the mold 11.

For this purpose, the foot rollers 25 can be installed on a common support element 26 attached to the mold 11.

In accordance with possible solutions, the foot rollers 25 can be grouped into at least one group of foot rollers, in the case shown in FIG. 1 two groups of foot rollers 25, distanced along the casting line Z. Each group of foot rollers 25 at least partly surrounds, during use, a cross section of the cast product P.

The foot rollers 25 of each group are located on a same lying plane parallel to the cross section of the cast product P.

The foot rollers 25 are installed directly downstream of the exit of the crystallizer 12.

In accordance with a possible implementation of the invention, the mold 11 can comprise a number of quadruples of foot rollers 25 comprised between 1 and 3, preferably 2.

The foot rollers 25 can be disposed according to patterns similar to those for positioning the containing rollers 23 and shown, by way of example only, in FIGS. 5-8.

In accordance with possible solutions, the foot rollers 25 are installed in a longitudinal portion of the casting line Z having a guide length LG.

The guide length LG can be comprised between 150 mm and 800 mm, preferably between 200 mm and 500 mm.

In possible implementations of the invention, the containing device 21 extends for a containing length LC determined, on each occasion, as a function of at least the width W of the side of the polygon defining the cross section of the casting cavity 13, the maximum admissible deformation camber F of said side of the polygon during casting, and the casting speed Vc.

The production method in accordance with the present invention provides to determine the minimum containing length LC of the containing device 21 with rollers. With the term minimum containing length it can also be understood that the method can also provide an indication of the fact that, due to the particular functioning conditions set, the containing device with rollers is not necessary since the containing length LC is zero. In fact, the Applicant has found experimentally that as a function of the sizes of the side of the polygon it is possible to determine the minimum containing length LC which is able to prevent the phenomenon of bulging or, worse, of break-out of the skin of the cast product P.

In this way, it is possible to reduce to the bare minimum the number of containing units 22 required, that is, the number of containing rollers 23, with a consequent reduction in the actions of adjustment/alignment required for the latter.

According to some embodiments of the invention, the containing length LC of the containing device 21 is determined starting from the exit end of the foot rollers 25 up to the exit end of the containing device 21.

In accordance with one aspect of the present invention, the containing length LC is correlated to the maximum admissible deformation camber F of each side of the polygon, that is, to the maximum deformation allowed and due to the bulging effect.

The deformation camber can be expressed in absolute terms, and in this case is indicated with "F" and is measured in millimeters [mm], or it can be expressed in relative terms (or percentages) with respect to the width W of the side and in this case is indicated with "f=F/W" and is dimensionless.

In accordance with a possible solution, the camber "f" is comprised between 0.2% and 5%, preferably between 0.2% and 3%, even more preferably between 0.3% and 1.5%, the width W of the polygon side.

In accordance with a possible solution, the containing length LC is determined as a function of the casting speed Vc of the cast product P.

According to possible implementations, the casting speed Vc is greater than 6 m/min, preferably greater than 6.5 m/min. These speeds can be reached, for example, with an octagonal cross section of sizes equivalent to those of a square cross section with a side comprised between 130 and 160 mm.

This setting of the casting speed Vc allows to reach a high productivity of the steel plant, in which the apparatus 10 is installed.

According to other possible implementations, the casting speed Vc can also be very low, for example lower than 1 m/min, or equal to 0.5 m/min, for example in the production of special steels which require high quality, or in the event polygonal cross sections with large sizes are cast, corresponding for example to equivalent square cross sections having a side even up to 750 mm.

According to possible solutions, the containing length LC is also determined as a function of the geometry of the casting apparatus 10.

In some embodiments, the containing length LC is determined at least in relation to the machine radius Rm (FIG. 1), that is, the radius of curvature of the casting line Z.

The machine radius Rm can be a value comprised between 5 m and 25 m, preferably between 7 m and 20 m, even more preferably between 7 m and 18 m.

In accordance with possible implementations of the invention, the containing length LC is also determined in relation to the type of material being cast. By way of example only, the containing length LC of the containing device 21 is at least correlated to one of the following parameters of the material: elasticity modulus, or Young's modulus, thickness of solidified skin, and density ρ.

The Young modulus is a variable value along the longitudinal extension of the cast product P, in relation to the temperature of the latter, at least along the extension of the containing length LC.

By way of example only, the Young modulus, along the extension of the containing length LC, can have a median value comprised between about 50 MPa and about 60 MPa.

The thickness of solidified skin increases over time proportionally to a solidification constant K which can be determined from literature and is a value that varies in relation to the sizes and type of cast product P, and therefore to the casting process that is implemented.

By way of example only, the solidification constant K can be comprised between 3*10^−3 and 5*10^−3 m/s^0.5, preferably between 3.2*10^−3 and 4.1*10^−3 m/s^0.5.

The density ρ of the material, as far as the steel casting is concerned, can be set to a value of about 7750 kg/m^3.

According to a possible implementation of the invention, the containing length LC as above is:

equal to zero if L≤LM+LG equal to L−(LM+LG) if L>LM+LG where:

LM: is the length of the crystallizer 12;

LG: is the guide length in which the foot rollers 25 are located;

L is determined so as to satisfy the following equation:

$$L^{1,5} - \frac{\rho \cdot g \cdot Rm \cdot W^3 \cdot Vc^{1,5} \cdot \sin(L/Rm)}{32 \cdot E \cdot f \cdot K^3} = 0 \quad \text{(Eq. 1)}$$

where:

ρ: is the density of the cast material g: is the gravitational acceleration

E: is the Young modulus

K: is the solidification constant

W: is the width of the side of the polygonal cast product

Vc: is the casting speed

Rm: is the radius of curvature of the casting line Z f: is the maximum admissible deformation camber of the side, expressed as a percentage on the width W of the side of the polygon.

The equation Eq. 1 above was determined taking into consideration that the skin of the cast product P, at exit from the containing device 21, has to have a thickness such that, under the action of the liquid metal head, the sides of the cross section of the cast product deform at most by a predefined camber "f".

Figure 10:
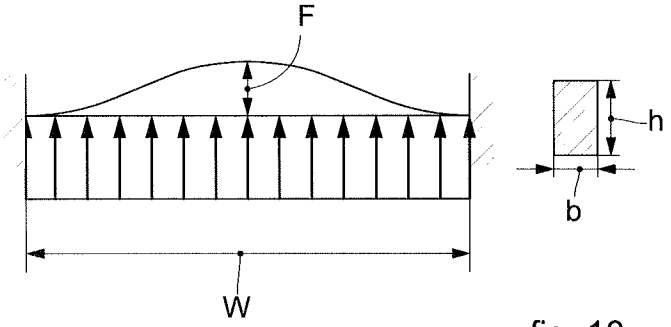
FIG. 10 is a schematic graph of the development of the deformation camber of one side of a polygon.

Specifically, the sides of the polygon of the cast product P have a behavior that reasonably approximates that of a beam fixed at its ends and subjected to a uniformly distributed load which is the ferrostatic pressure, as shown in FIG. 10. The cross section of this beam has a rectangular shape with a shorter side "b" and a longer side "h". The latter represents the thickness of the solidified skin in the flexion plane of the beam.

Figure 11:
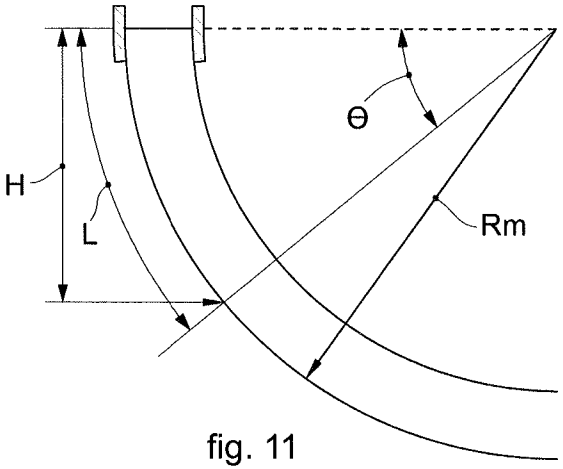
FIG. 11 is a schematic illustration of a casting line.

The camber "f" can therefore be determined by the equation:

$$f = \frac{p \cdot b \cdot W^4}{384 \cdot E \cdot I}$$

where:

"p" is the distributed load acting on the skin of the cast product P at exit from the containing device 21 and which can be determined by the equation: p=ρ·g·H , where H (FIG. 11) is the height of the liquid metal head that acts on the skin of the cast product P at exit from the containing device 21. H can also be determined as H=Rm·sin(θ)=Rm·sin(L/Rm)

"I" is the quadratic surface moment of the resistant cross section defined by the equation $$I = \frac{b \cdot h^3}{12},$$

where "h" represents the thickness of solidified skin, which can also be expressed by the empirical formula $h=K\sqrt{(L/Vc)}$.

The equation Eq. 1 reported above, in general terms, always allows the zero solution and possibly also other solutions.

The equation Eq. 1 reported above for the determination of "L" identifies a function whose result to be considered for the purposes of the present invention is the first useful solution of "L" different from zero, or, if other solutions are not allowed, L is to be considered equal to zero.

When L is equal to zero, this means that it is not necessary to provide the containing device 21.

For containing length values $$LC > \left[\frac{\pi \cdot Rm}{2} - (LM + LG)\right],$$

it is assumed that $$LC = \left[\frac{\pi \cdot Rm}{2} - (LM + LG)\right].$$

The equation Eq. 1 for the determination of L, reported above, is defined by the difference of two functions shown in FIGS. 12-15, of which a first exponential function F1 $L^{1.5}$, and a second sinusoidal function F2

$$\frac{\rho \cdot g \cdot Rm \cdot W^3 \cdot Vc^{1.5} \cdot \sin(L/Rm)}{32 \cdot E \cdot f \cdot K^3}.$$

FIGS. 12-15 show example embodiments for determining the length L.

Figure 12:
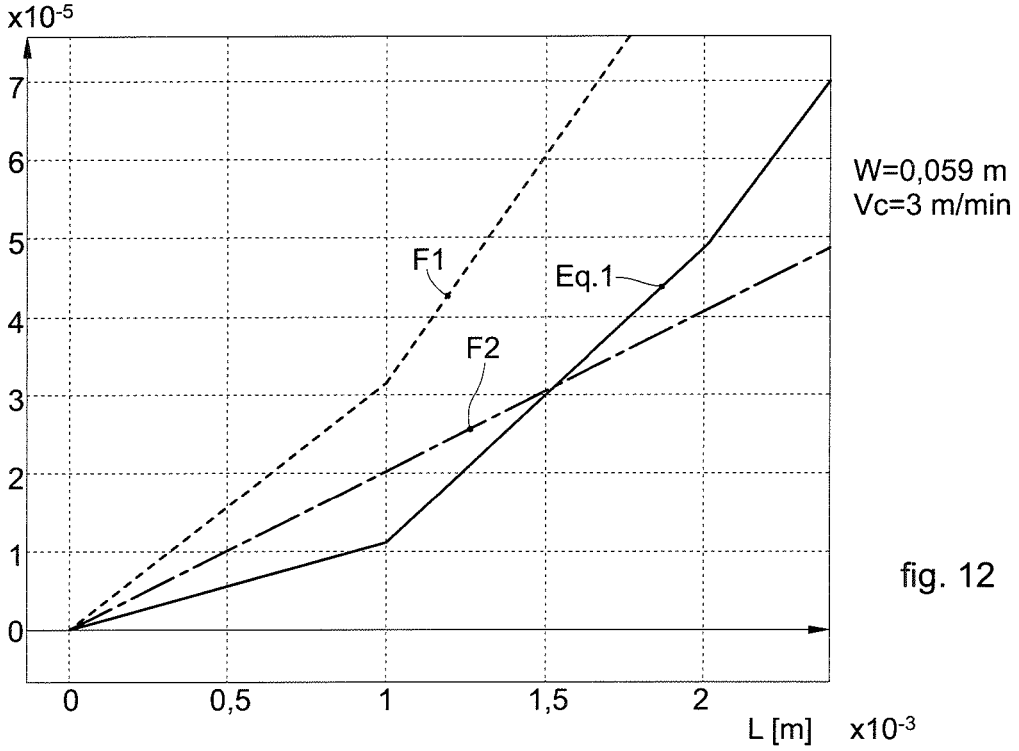
FIGS. 12-15 show graphs of functions for determining a containing length of the cast product.

In the first example of FIG. 12 it is assumed that ρ=7750 kg/m$^3$, E=54.8 MPa, K=3.68*10$^{-3}$ m/s$^{0.5}$, W=0.059 m, f=1%, Rm=9 m, Vc=3 m/min. From the graph of FIG. 12 it is possible to verify that in the development of the curve Eq. 1, corresponding to the difference between the two functions F1 and F2, there are no intersections with the X axis and therefore it is assumed that L is equal to zero.

Figure 13:
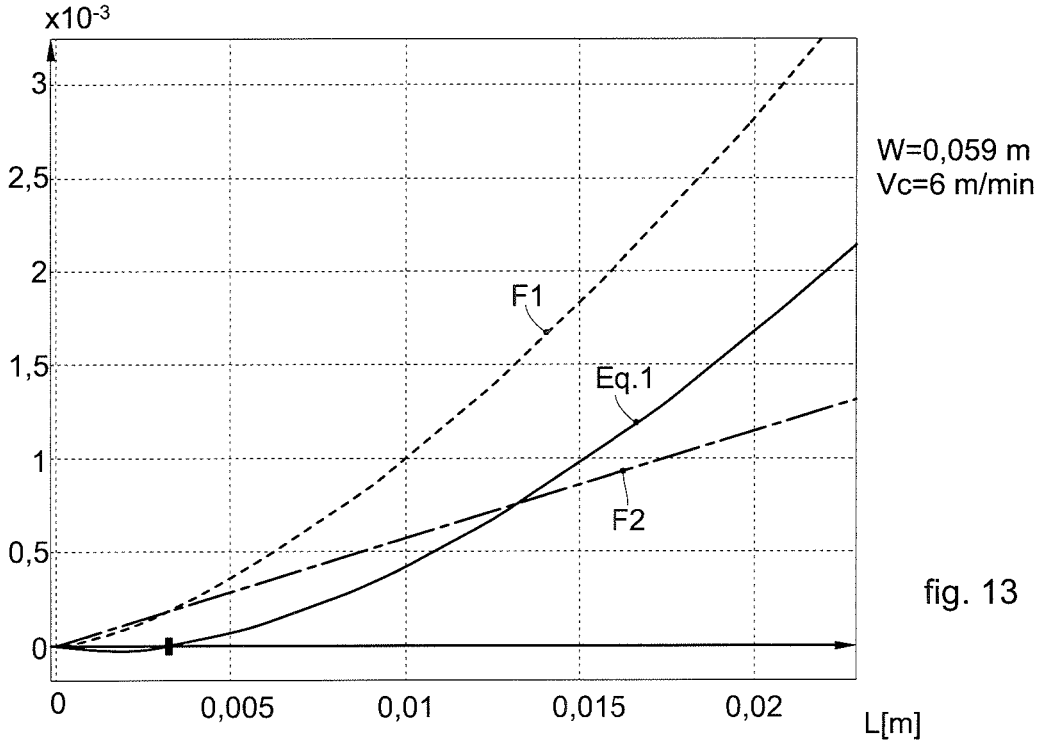

In the second example of FIG. 13 it is assumed that ρ=7750 kg/m$^3$, E=54.8 MPa, K=3.68*10$^{-3}$ m/s$^{0.5}$, W=0.059 m, f=1%, Rm=9 m, Vc=6 m/min. From the graph of FIG. 13 it is possible to determine L equal to about 0.004 m, that is, a containing length LC=0.

Figure 14:
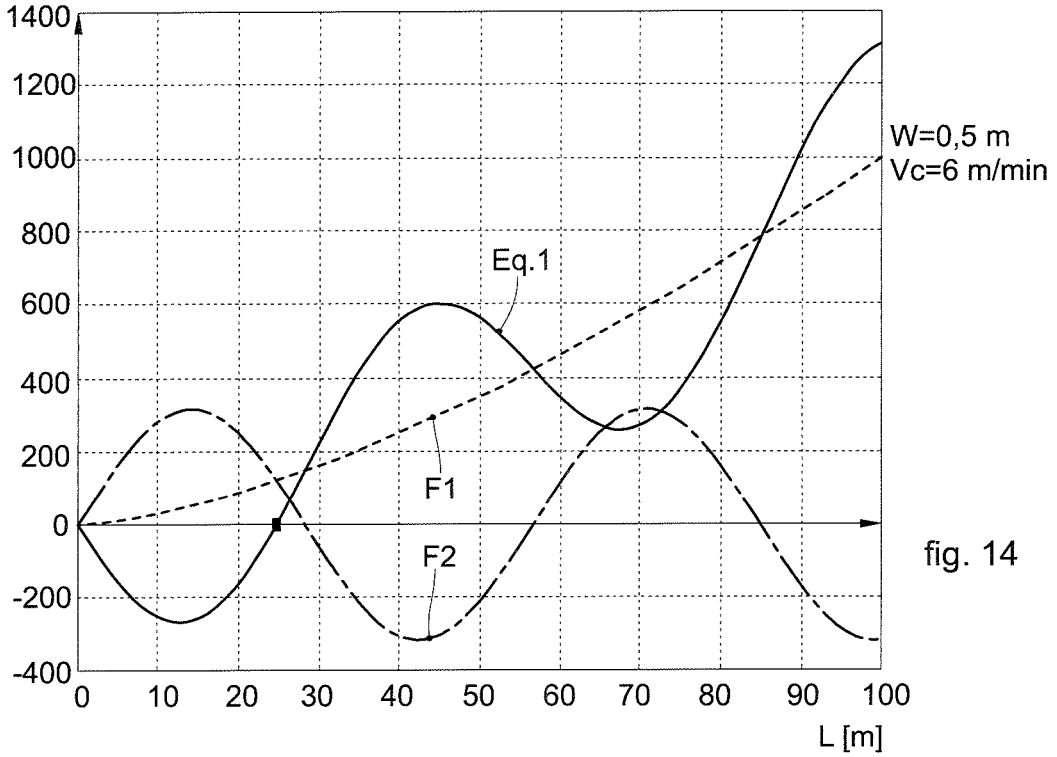

In the third example of FIG. 14 it is assumed that ρ=7750 kg/m$^3$, E=54.8 MPa, K=3.68*10$^{-3}$ m/s$^{0.5}$, W=0.5 m, f=1%, Rm=9 m, Vc=6 m/min. From the graph of FIG. 14 it is possible to determine L equal to about 25 m, that is, a containing length LC which extends over the entire length of the casting line, given that the development of the curve Eq. 1 intersects the X axis at this value.

Figure 15:
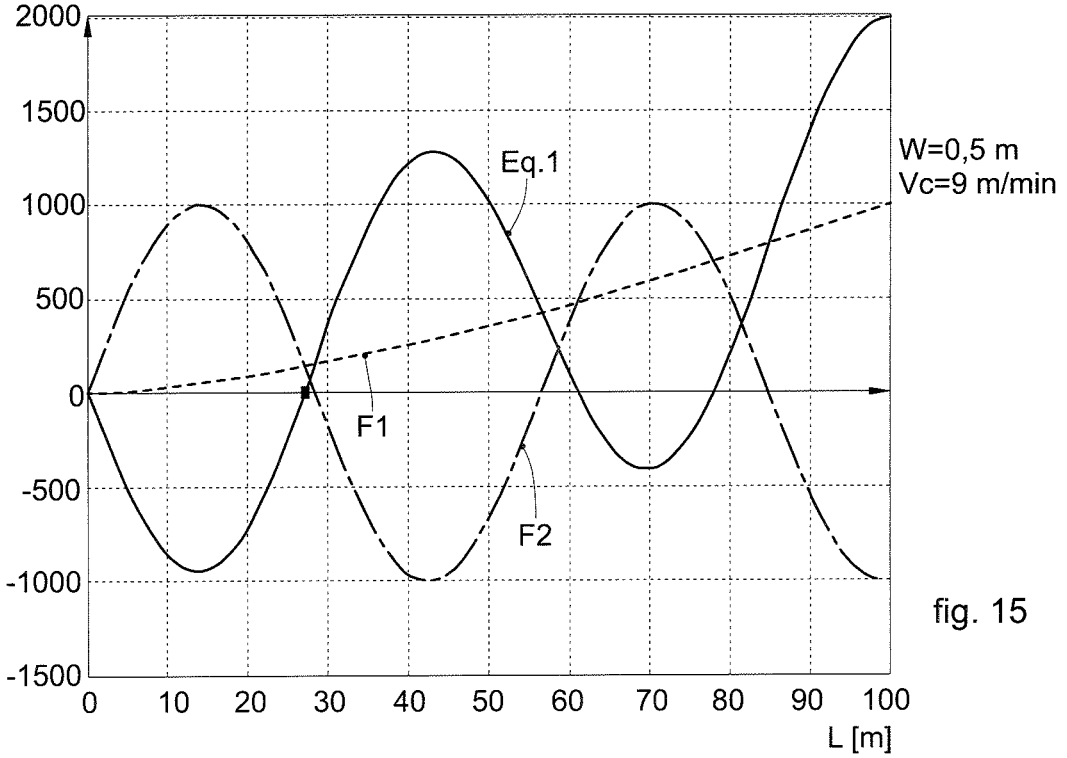

In the fourth example of FIG. 15 it is assumed that ρ=7750 kg/m$^3$, E=54.8 MPa, K=3.68*10$^{-3}$ m/s$^{0.5}$, W=0.6 m, f=1%, Rm=9 m, Vc=9 m/min. From the graph of FIG. 15, using the method as above, it is possible to determine L equal to about 27 m, that is, a containing length LC that extends over the entire length of the casting line. It should be noted that the value to be considered is the first point of intersection of the X axis, with L>0 since the development of the curve Eq. 1 intersects the X axis several times.

Figure 16:
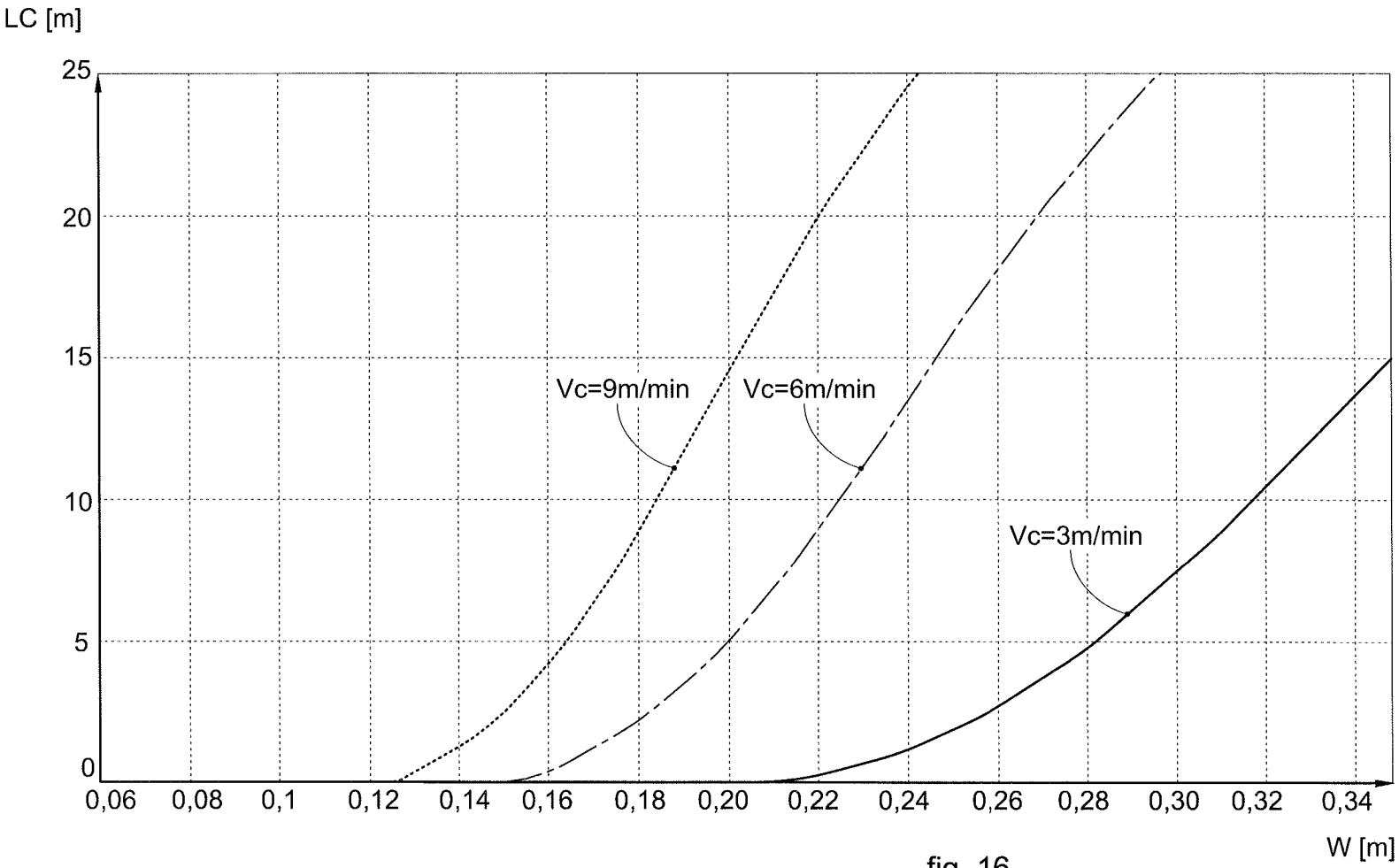
FIG. 16 is a graph that correlates the containing length, the width of the side and the casting speed.

FIG. 16 is, on the other hand, a graph that shows the development of the minimum containing length LC for different casting speeds Vc, that is, for casting speed of 3 m/s, 6 m/s and 9 m/s, and as the width W of the side of the billet varies.

Specifically, the graph of FIG. 16 is determined by setting ρ=7750 kg/m$^3$, E=54.8 MPa, f=1%, Rm=16 m, a steel temperature of about 1073K, LC=0.9 m, LG=0.35 m.

On the basis of the parameters that can be determined with the teachings according to the present invention, a person of skill in the art will be able to evaluate, on each occasion, and according to the project requirements, related for example to productivity, the type of products to be cast, the maximum containing lengths that he is willing to accept, what the construction parameters of the apparatus to be obtained are.

By way of example only, a person of skill in the art will be able to evaluate the maximum casting speed that can be reached without containment for different geometries of the cross section of the cast product, see for example the cross sections S1, S2, S3, S4, S5, S6 and S7 of cast product shown in FIG. 9. Or, in relation to a desired productivity, with the present invention it is possible to determine a combination of polygon shape, casting sizes and speeds which allow to eliminate or minimize the containing length LC.

In accordance with another embodiment of the invention, the apparatus 10 comprises at least one guide mean 27, in this case two guide means 27, installed downstream of the containing device 21 and configured to guide the cast product P along the casting line Z.

In accordance with a possible embodiment of the invention, each guide mean 27 comprises at least, in this specific case only, a pair of guide rollers 28 positioned respectively on the intrados and extrados side of the cast product P.

The guide means 27 are installed in a fixed position and are configured to guide the cast product P downstream of the containing device 21 along the casting line Z.

The apparatus, in accordance with the present invention, is also provided with a plurality of cooling members, not shown in the drawings, installed downstream of the mold 11 and configured to cool the cast product P. The cooling members can comprise a plurality of delivery nozzles, interposed between the guide rollers 26, the containing rollers 26 and the guide rollers 28, and configured to deliver a liquid to cool the cast product P.

The apparatus 10 described heretofore can be advantageously installed in a steel plant in which a casting line directly feeds the rolling line, for example in endless mode, greatly reducing or eliminating the need for an intermediate heating, thanks to the higher casting speed and therefore the higher temperature of the cast product.

Figure 17:
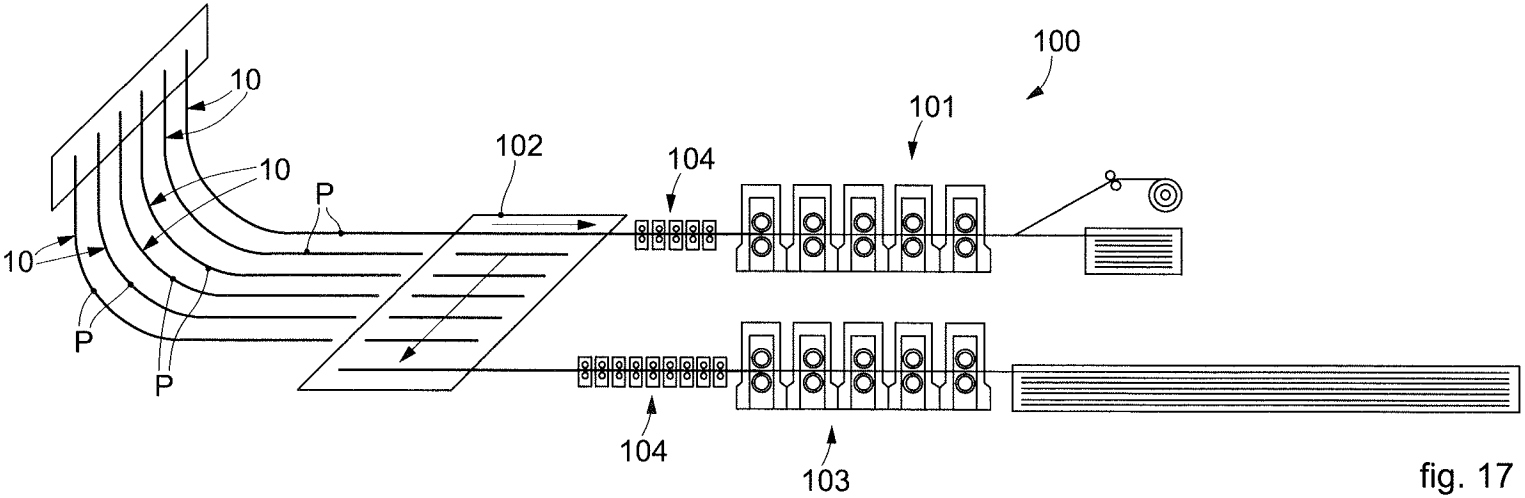
FIG. 17 is a schematic illustration of a possible application of the present invention.

In accordance with possible implementations (FIG. 17), the apparatus 10 described above can also be installed in a steel plant 100 provided with several casting lines for the production of billets or blooms.

The plant 100 can comprise a first rolling line 101 located directly in line with a first casting line, and configured to roll the cast product for example in endless mode (co-rolling).

The plant can also comprise further casting lines parallel to the first, which feed a second rolling line 103 in direct hot charge mode, by means of a common transfer plate 102 located downstream of the casting lines.

An induction heating device 104 can be interposed directly upstream of the first rolling line 101 and/or of the second rolling line 103, to rapidly heat the billets or blooms.

It is clear that modifications and/or additions of parts may be made to the apparatus 10 and method as described heretofore, without departing from the field and scope of the present invention.

It is also clear that, although the present invention has been described with reference to some specific examples, a person of skill in the art shall certainly be able to achieve many other equivalent forms of apparatus 10 and method, having the characteristics as set forth in the claims and hence all coming within the field of protection defined thereby.

The invention claimed is:

1. A method to obtain a continuous casting apparatus to cast, through a casting cavity (13) of a crystallizer (14) of a mold (11), a cast product (P) with a polygonal cross section (Si, S2, S3, S4, S5, S6, S7), wherein said method provides to determine a minimum containing length (LC) of a containing device (21) with rollers, located downstream of said mold (11) and configured to contain a deformation of said cast product (P) with the containing device (21) with rollers, said minimum containing length (LC) being determined, on each occasion, as a function at least of a width (W) of a side of the polygon, of a maximum admissible deformation camber (f) of said side of the polygon outside the mold (11), and of a casting speed (Vc).

2. The method as in claim 1, wherein said crystallizer (12) has a crystallizer length (LM), wherein said mold (11) comprises a plurality of guide rollers (25) disposed at an exit end of the crystallizer (12) and that extend for a guide length (LG) along a casting line (Z), and wherein said containing length (LC) is:

equal to zero if L<LM+LG equal to L−(LM+LG) if L>LM+LG where:

LM: is the length of the crystallizer (12);

LG: is the guide length covered by the guide rollers (25);

L is determined so as to satisfy the following equation:

$$L^{1,5} - \frac{\rho \cdot g \cdot Rm \cdot W^3 \cdot Vc^{1,5} \cdot \sin(L/Rm)}{32 \cdot E \cdot f \cdot K^3} = 0$$

where:

ρ: is the density of a cast material g: is the gravitational acceleration

E: is the Young modulus

K: is a solidification constant

W: is the width of the side of the polygonal cast product

Vc: is the casting speed

Rm: is a radius of curvature of the casting line Z f: is the maximum admissible deformation camber of the side, expressed as a percentage of the width W of the side of the polygon.

3. The method as in claim 2, wherein when, $$LC > \left[\frac{\pi \cdot Rm}{2} - (LM + LG)\right],$$

the value of LC calculated and assigned to be $$LC = \left[\frac{\pi \cdot Rm}{2} - (LM + LG)\right].$$

.

4. The method as in claim 2, wherein said maximum admissible deformation camber (f) is comprised between 0.2% and 5% of the width W of the side of the polygon.

5. The method as in claim 2, wherein said maximum admissible deformation camber (f) is comprised between 0.2% and 3% of the width W of the side of the polygon.

6. The method as in claim 2, wherein said maximum admissible deformation camber (f) is comprised between 0.3% and 1.5% of the width W of the side of the polygon.

7. The method as in claim 1, wherein said casting speed (Vc) is greater than 6 m/min.

8. The method as in claim 1, wherein the number of sides of said cross section (S1, S2, S3, S4, S5, S6, S7) is an even number.

9. The method as in claim 8, wherein said cross section (S1, S2, S3, S4, S5, S6, S7) is shaped as a regular or irregular polygon.

10. The method as in claim 1, wherein said casting cavity (13) has an octagonal cross section shape.

11. The method as in claim 1, wherein said casting speed (Vc) is greater than 6.5 m/min.

12. The method as in claim 1, wherein the number of sides of said cross section (S1, S2, S3, S4, S5, S6, S7) is a multiple of four.

13. The method as in claim 1, wherein the number of sides of said cross section (S1, S2, S3, S4, S5, S6, S7) is four.

* * * * *